US006834441B2

(12) United States Patent
Damrath et al.

(10) Patent No.: US 6,834,441 B2
(45) Date of Patent: Dec. 28, 2004

(54) APPARATUS FOR PRESSING SHIRTS

(75) Inventors: Joachim Damrath, Bachhagel (DE); Klaus Grunert, Berlin (DE); Oliver Käfer, München (DE); Markus Spielmannleitner, Ellwangen (DE); Gerhard Wetzl, Sontheim (DE)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 0 days.

(21) Appl. No.: 10/600,912

(22) Filed: Jun. 20, 2003

(65) Prior Publication Data

US 2004/0221472 A1 Nov. 11, 2004

Related U.S. Application Data

(63) Continuation of application No. PCT/EP01/14116, filed on Dec. 3, 2001.

(30) Foreign Application Priority Data

Dec. 20, 2000 (DE) ..... 100 63 671

(51) Int. Cl.[7] ..... F26B 19/00
(52) U.S. Cl. ..... 34/60; 34/621; 223/71
(58) Field of Search ..... 34/60, 103, 109, 34/126, 131, 218, 239, 621; 134/11, 19; 38/7, 12; 223/71, 72

(56) References Cited

U.S. PATENT DOCUMENTS 2,417,838 A 3/1947 Paris
3,727,811 A * 4/1973 Buckley ..... 223/70
3,892,047 A * 7/1975 Muller-Scherak ..... 34/103
3,961,733 A * 6/1976 Kannegiesser et al. ..... 223/57
4,815,219 A * 3/1989 Binger ..... 34/443
5,148,955 A * 9/1992 Cares ..... 223/70
5,334,072 A * 8/1994 Epstein ..... 446/224
5,555,649 A * 9/1996 Phillipson ..... 34/666
5,947,706 A * 9/1999 Gapinski ..... 417/437
5,975,643 A * 11/1999 Smith et al. ..... 298/22 R
6,041,517 A 3/2000 Wang

FOREIGN PATENT DOCUMENTS

WO WO 99/49123 9/1999

* cited by examiner

*Primary Examiner*—Stephen Gravini
(74) *Attorney, Agent, or Firm*—Laurence A. Greenberg; Werner H. Stemer; Ralph E. Locher

(57) ABSTRACT

A shirt-smoothing device includes a lower part and an inflatable body fixed thereon. Because the inflatable body must be at least the same size as the shirt to be smoothed, the device has considerable height, however, the rigid components in the area of the inflatable body are lowerable to handle the device more easily and, more particularly, to stow it away easily. An internally disposed supporting frame and a button strip tensioner disposed in front of the inflatable body can be lowered after use into the lower part, whereby the inflatable body, which is exclusively connected to the supporting frame at the top becomes folded. The same applies to flexible inflatable support bodied and support nets disposed between the inflatable body and the supporting frame. The storage space required for the shirt smoothing device can be substantially reduced by the invention and the handling and storage thereof simplified.

13 Claims, 2 Drawing Sheets

APPARATUS FOR PRESSING SHIRTS

CROSS-REFERENCE TO RELATED APPLICATION

This application is a continuation of copending International Application No. PCT/EP01/14116, filed Dec. 3, 2001, which designated the United States and was not published in English.

BACKGROUND OF THE INVENTION

Field of the Invention

The invention relates to an apparatus for pressing shirts having a flexible inflatable body, a bottom part having a fan for inflating the inflatable body and on which the inflatable body is fastened by way of a bottom section, and a top part, which is disposed above the bottom part and on which the inflatable body is fastened by way of a top section and is connected to the bottom part by a load-bearing structure disposed within the inflatable body, the load-bearing structure being connected in a vertically displaceable manner to the bottom part.

Such an apparatus is known, for example, from German Published, Non-Prosecuted Patent Application DE 199 13 642 A1. This document describes an apparatus for drying and/or pressing damp laundry, in the case of which a collar-retaining device is firmly disposed above the inflatable body. Furthermore, a bottom part with further necessary components is disposed beneath the inflatable body, which has to be at least as high as the shirts that are to be pressed. This results in the appliance having a considerable overall height, which makes it difficult to accommodate.

SUMMARY OF THE INVENTION

It is accordingly an object of the invention to provide an apparatus for pressing shirts that overcomes the hereinaforementioned disadvantages of the heretofore-known devices of this general type and that achieves a more compact configuration to render the apparatus easier to accommodate.

With the foregoing and other objects in view, there is provided, in accordance with the invention, an apparatus for pressing shirts, including a flexible inflatable body having a bottom section and a top section, a bottom part having a fan communicating with the inflatable body for inflating the inflatable body, the inflatable body fastened to the bottom part at the bottom section, a load-bearing structure disposed within the inflatable body and connected in a vertically displaceable manner to the bottom part, a top part being disposed above the bottom part, the inflatable body fastened to the top part at the top section, the load-bearing structure connecting the top part to the bottom part, and the load-bearing structure being movably disposed to assume an extended position in which the load-bearing structure is extended out of the bottom part when the apparatus is in operation and a retracted position in which the load-bearing structure is retracted into the bottom part when the apparatus is not in operation.

By virtue of the inflatable body contributing largely to the overall height of the shirt-pressing apparatus, the invention makes it possible to achieve considerably more compact dimensions of the shirt-pressing apparatus outside the operating state. It is precisely in this state in which the apparatus has to be stowed away that small dimensions are necessary. In the operating state, in contrast, a large height does not prove disadvantageous because, in order to be used, the shirt-pressing apparatus has to be set up in unconfined conditions in any case. Within the inflatable body, it is possible to dispose further inner inflatable bodies, which are subjected, in particular, to relatively high pressure and can, likewise, be folded up when the top part is lowered. These inner inflatable bodies can be supported on the load-bearing structure to make possible for the inflatable-body enclosure to be forced specifically outward at certain locations. It is possible, here, for the connecting elements between the inner inflatable bodies and the load-bearing structure, for the purpose of absorbing the compressive forces, to be fastened in a displaceable manner on the load-bearing structure so that they can be pushed together when the load-bearing structure is lowered. The inner inflatable bodies may, thus, be provided with loops or rings that can be displaced along the load-bearing structure. Use may also be made, as load-bearing structure, of lowerable bars between which nettings or air-permeable fabric sections are tensioned, it being possible for the inner inflatable bodies to be supported against these and for their connections to the bars to be displaced along the latter. For example, the nettings or the air-permeable fabric sections may be fastened on the bars by straightforward loops or rings.

In accordance with another feature of the invention, there is provided a connecting device for transmitting at least one of tensile forces and compressive forces, the connecting device connecting the load-bearing structure to the inflatable body between regions in which the inflatable body is fastened to the bottom part and to the top part, the connecting device being displaceably connected along the load-bearing structure.

To insure that the operation of lowering a button-strip clamp is not obstructed, a connection between the load-bearing structure and the button-strip clamp is, advantageously, only disposed at the top end. As a result, the region of the inflatable body that is located therebetween can fold up during lowering of the load-bearing structure and/or of the button-strip clamp.

In accordance with a further-feature of the invention, the inflatable body has an inside and the connecting device is pulling strips fastened on the inside and delimit inflation of the inflatable body.

In accordance with an added feature of the invention, the connecting device is inflatable air cushions disposed in the inflatable body and forcing the inflatable body outward at given locations.

It is the case with the button-strip clamp envisaged that the inflatable body, which is tensioned during operation, butts at the rear against the rear side of the button-strip clamp. This may result, on the two sides of the button-strip clamp, in producing a spacing between the inflatable body and a tensioned shirt because both the shirt and the inflatable body are pulled taut and located between the shirt and the inflatable body is a part of the button-strip clamp against which the button strip or buttonhole strip is clamped for fixing purposes. Such a spacing results in the inflatable bag not fitting closely against those regions of the shirt that are located in the vicinity of the button-strip clamp, and this may impair the pressing result in these regions.

To prevent this, the rear side of the button-strip clamp is substantially curved and, at the borders, moves at a shallow angle toward the plane in which the button strip or the buttonhole strip of a shirt that is to be pressed is clamped firmly. It is, thus, possible for the inflatable body in the inflated state, at a very small spacing from the borders of the button-strip clamp, to fit closely from the rear against the shirt that is to be pressed. The regions of the shirt in the vicinity of the button strip or of the buttonhole strip are, thus, not exposed to any abrupt transitions. As a result, it is possible to achieve pressing of the shirt without folds.

In accordance with an additional feature of the invention, there is provided a button-strip clamp for fixing one of the button strip of a shirt and a buttonhole strip of the shirt, the button-strip clamp being fastened in a vertically displaceable manner on the bottom part.

In accordance with yet another feature of the invention, the button-strip clamp and the load-bearing structure are coupled to one another with respect to vertical displacement.

In accordance with yet a further feature of the invention, the button-strip clamp and the load-bearing structure are vertical displaceably coupled to one another.

In accordance with yet an added feature of the invention, the button-strip clamp has a top connected to the top part.

In accordance with yet an additional feature of the invention, the button-strip clamp has a rear side, the inflatable body with the load-bearing structure pushes upward in an inflated state of the inflatable body and butts against the rear side of the button-strip clamp in the pushed upward state, the button-strip clamp has clamping surfaces against which one of the button strip or the buttonhole strip are to be pressed for fixing the button strip or the buttonhole strip, the clamping surfaces define a plane and have lateral borders, and the rear side of the button-strip clamp is located in a vicinity of the plane of the clamping surfaces at least at the lateral borders.

In accordance with again another feature of the invention, the clamping surfaces have outer borders, the rear side of the button-strip clamp has borders, and the borders of the rear side of the button-strip clamp are connected to the outer borders of the clamping surfaces and enclose an acute angle with the outer borders of the clamping surfaces.

In accordance with a concomitant feature of the invention, the load-bearing structure has a plurality of supporting rods connected to one another and disposed substantially parallel to one another, only one of the supporting rods is mounted axially in the bottom part and is secured against tilting, and a remainder of the supporting rods are guided axially in the bottom part and are not secured against tilting.

Other features that are considered as characteristic for the invention are set forth in the appended claims.

Although the invention is illustrated and described herein as embodied in an apparatus for pressing shirts, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figures 1, 2:
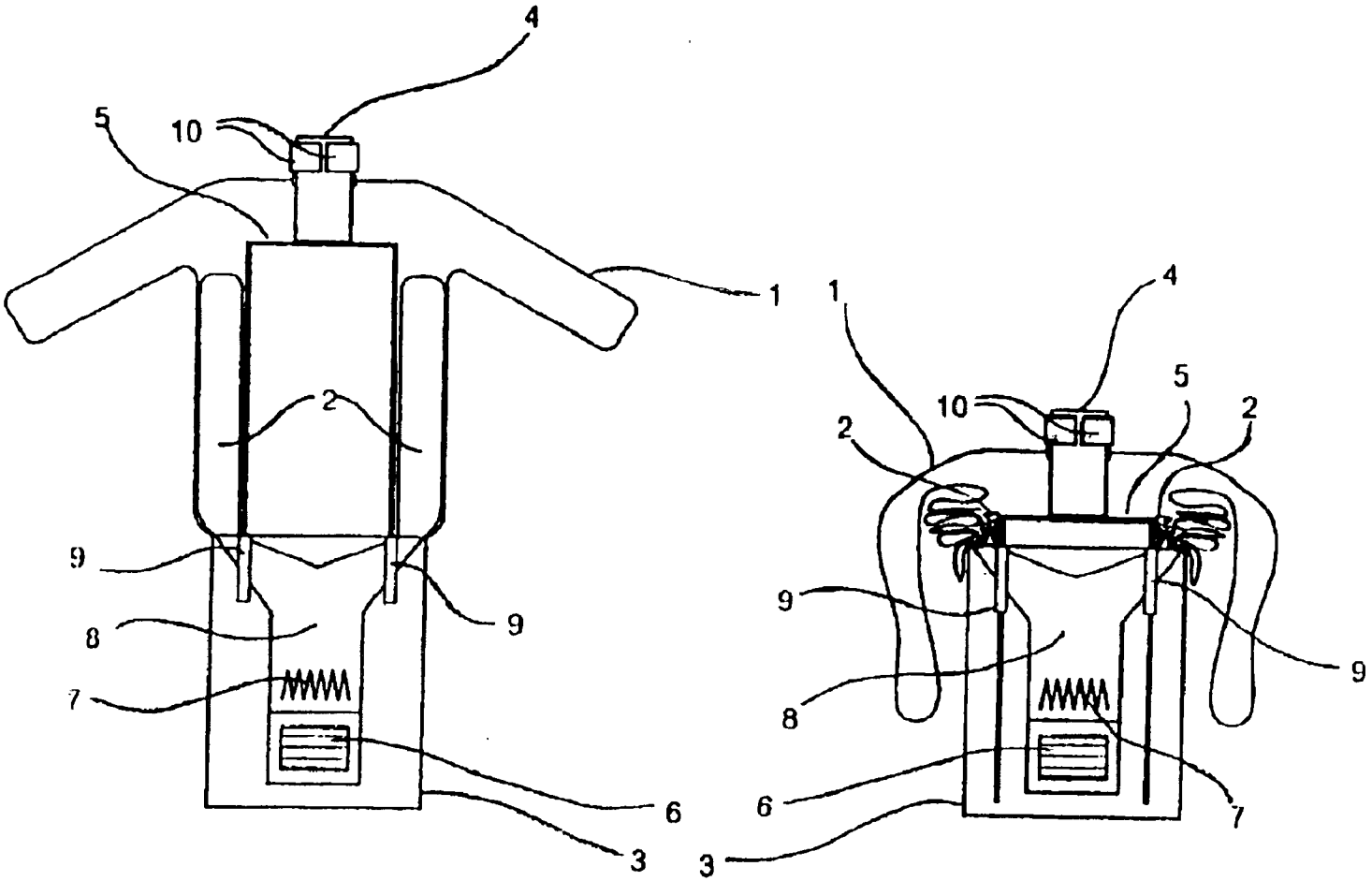
FIG. 1 is a vertical cross-sectional view from the front of an apparatus for pressing shirts according to the invention in an extended, operating state.
FIG. 2 is a vertical cross-sectional view from the front of the shirt-pressing apparatus of FIG. 1 in the pushed-together state.

Referring now to the figures of the drawings in detail and first, particularly to FIG. 1 thereof, there is shown a shirt-pressing apparatus having a bottom part 3 with a shirt-form inflatable body 1 that is fastened thereon and serves for tensioning a shirt that is pulled thereover. Disposed for such a purpose in the bottom part 3 are a fan 6, a heating device 7, and an air channel 8, by means of which a hot air stream can be produced. The air stream is divided up by the air channel 8 into two partial air streams, which are directed to a left-hand and a right-hand outlet opening of the bottom part 3.

In each case one of the two supporting bodies 2 is connected to the two outlet openings, the supporting bodies being disposed in the interior of the inflatable body 1 and serving for forcing the trunk section of the inflatable body 1 outward at the sides in order, thus, to provide it with a flat cross-section. The supporting bodies 2, like the inflatable body 1, are produced from an air-permeable, flexible material, for example, synthetic-fiber fabric. The supporting bodies 2 extend substantially over the entire height of the trunk section of the inflatable body 1.

Furthermore, a load-bearing framework 5 is fastened on the bottom part 3 such that it can be displaced vertically by bushings 9. In the extended state, the load-bearing framework 5 extends beyond the height of the supporting bodies 2 in the inflated state.

Fastened on the load-bearing framework 5 is a top part 4, on which the inflatable body 1 is fastened at the top and which serves for fixing and clamping the collar of a shirt fitted onto the inflatable body. Disposed for such a purpose on the top part 4 are two clamping flaps 10, by which the two ends of a turned-up collar can be fixed. The top part 4 also has a not illustrated device that is disposed at the rear and is intended for tensioning in the circumferential direction a shirt collar that is fixed at its ends.

Figure 3:
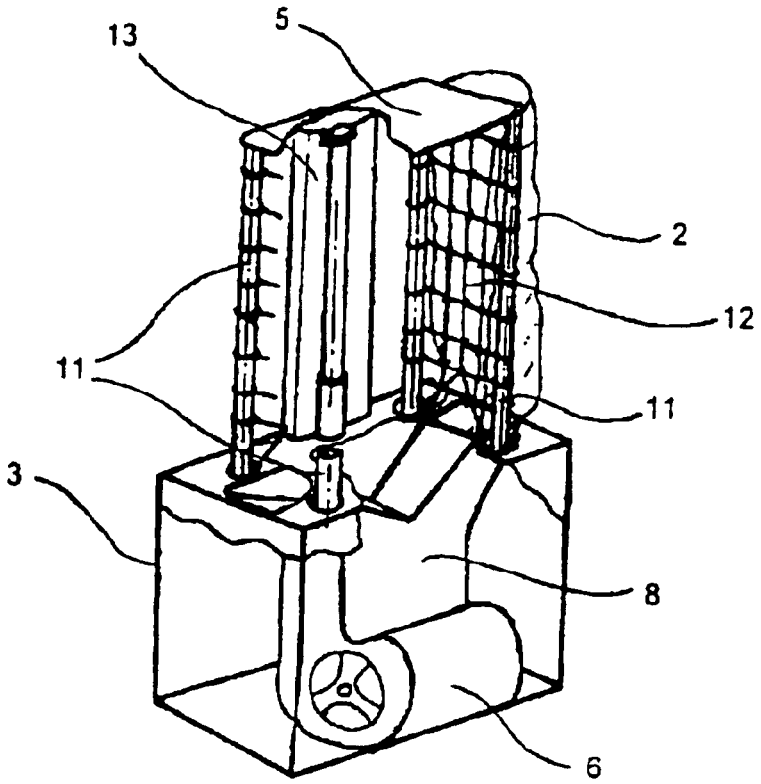
FIG. 3 is a perspective and partially cut away view of a number of interior components of the shirt-pressing apparatus of FIG. 1.

The interior structure for retaining and supporting the inflatable body 1 is illustrated in perspective, with further details, in FIG. 3. The load-bearing framework 5 includes four supporting tubes 11, which are mounted in a vertically disposable manner within the bushings 9 in the bottom part. In each case, one supporting netting 12 is tensioned between the two supporting tubes 11 disposed on the left (with respect to FIG. 3) and the two supporting tubes 11 disposed on the right. The supporting nettings 12 are fastened on the supporting tubes 11 on the sides by loops, it being possible for the loops to slide along the supporting tubes 11. The supporting nettings 12 serve for supporting the supporting bodies 2 so that the supporting bodies 2, in the inflated state, can subject the sides of the trunk section of the inflatable body 1 to an outwardly directed pressure from the inside. The supporting bodies 2 have a bottom section fastened on the outlet openings of the bottom part 3 and a top section fastened at the top end of the load-bearing framework 5. The supporting nettings 12 are fastened on the bottom part 3 at the bottom and at the top end of the load-bearing framework 5 at the top.

Figure 4:
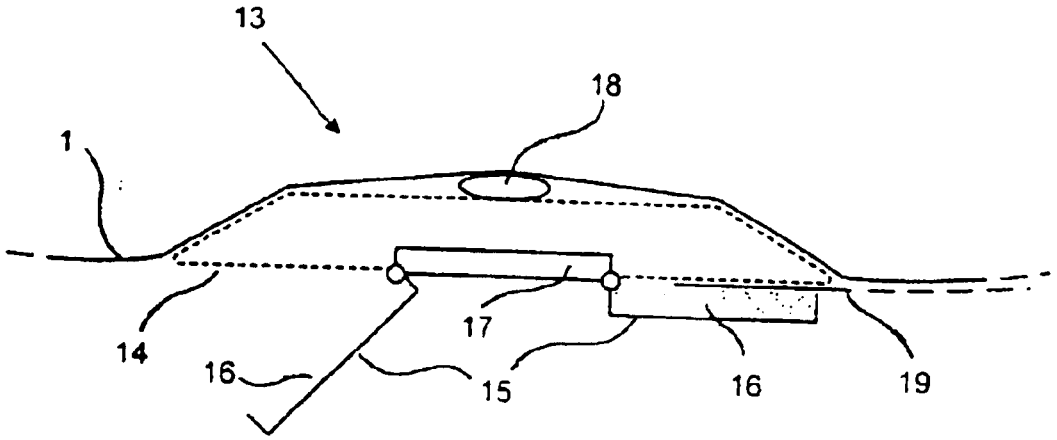
FIG. 4 is a fragmentary, horizontal, cross-sectional view through a button-strip clamp of the shirt-pressing apparatus according to the invention.

Furthermore, the bottom part 3 has a button-strip clamp 13, which is mounted in a vertically adjustable manner substantially in the center of the front border of the bottom part 3. The button-strip clamp 13, which is illustrated in cross-section in FIG. 4, serves for fixing the button strip or the buttonhole strip of a shirt 19 fitted onto the inflatable body so that the shirt 19 can be tensioned by the inflatable body 1. The button-strip clamp 13 has an oval supporting tube 18 and a supporting bar 17, between which is disposed an air-permeable clamping body 14, which may be produced, for example, from a perforated sheet. If the rest of the parts, in particular, the supporting bar 17 and the clamping body 14, are sufficiently stable, it is possible to dispense with the oval supporting tube 18. The clamping body 14 is in the form of a shallow trapezoid, of which the base surface is located on the side that is directed away from the inflatable body 1 and the side surfaces slope upward at a shallow angle.

Articulated on the borders of the supporting bar 17 in each case are flaps 15, which are subdivided into a plurality of sections over the height of the button-strip clamp 13. The flaps 15 each have fillings 16 made of a flexible and, if appropriate, air-permeable material. The fillings 16 may be provided with a non-slip coating on the surface on which the fabric of the shirt 19 ends up resting when the button strip or buttonhole strip is clamped firmly. This coating may have, for example, short bristles that are inclined inward, in the direction of the supporting bar 17 to make possible a retaining of the fabric of the shirt 19 counter to the outwardly directed pull when the inflatable body 1 is inflated. Each of the flaps 15 is assigned a respective spring element. The spring elements ensure that the flaps 15 are pressed against the clamping body 14 up to a certain point and, above the point, are retained in an open position, away from the clamping body. The individual spring elements may be individual links of a single spring plate. It is, thus, easily possible to use one part to create a plurality of spring elements that act independently of one another.

For pressing purposes, the shirt 19 is fitted, in particular, in a damp state, onto the inflatable body 1, with the load-bearing framework 5 extended. In such a case, in the first instance, the flaps 15 of the button-strip clamp 13 and the correspondingly configured flaps 10 of the top part 4 are opened. The button strip or the buttonhole strip and the collar tips are positioned beneath the flaps 15 and 10, respectively, and are fixed by virtue of the flaps 15 and 10 being closed. The shirt collar, for pressing purposes, is tensioned in the circumferential direction by actuation of the collar-tensioning and collar-clamping device in the top part 4. The fan 6 is, then, set in operation, together with the heating device 7, whereupon heated air is directed into the supporting body 2. From the supporting bodies 2, the air flows, through the air-permeable enclosures of the same, into the inflatable body 1, inflates the latter, and, then, flows through the, likewise, air-permeable enclosure of the latter, to the shirt 19 that has been fitted thereon, and is pressed by the action of tensioning and heat. In the stationary state, the pressure prevailing in the supporting bodies 2 is higher than that in the inflatable body 1, for example, a level of 6 mbar in the supporting bodies 2 in relation to a pressure of 3 mbar in the inflatable body 1. The supporting bodies 2 are supported in the inward direction against the supporting nettings 12 and force the trunk section of the inflatable body 1 outward at the sides.

A shirt 19 fitted onto the inflatable body in a damp state is tensioned by the inflated inflatable body 1, dried in the process, and, thus, pressed. In such a case, the inflatable body 1 positions itself against the button-strip clamp 13 from the rear, it being possible for the air to flow through the air-permeable clamping body 14 to the fixed button strip or buttonhole strip to dry the same. On account of the inclined side surfaces of the clamping body 14, the inflatable body 1, from a very small spacing from the clamping body 14, butts against the shirt 19 from the rear. The regions of the shirt 19 in the vicinity of the button strip or of the buttonhole strip are, thus, retained without creases. As a result, no folds are produced by the fixing device during pressing.

Following operation, it is advantageous, for the purpose of accommodating the shirt-pressing apparatus, if the latter has small dimensions. For such a purpose, as is illustrated in FIG. 2, the load-bearing framework 5 is pushed downward, the supporting tubes 11 being pushed, through the bushings 9, into the bottom part 3. At the same time, the button-strip clamp 13 is also pushed into the bottom part 3. Because both the inflatable body 1 and the supporting bodies 2 and supporting nettings 12 are only fastened at two points at the bottom and top, these are folded up above the bottom part 3 when the load-bearing structure 5 is lowered. In such a state, the inflatable body 1, the supporting bodies 2, and the supporting nettings 12 only take up a fraction of the space that they take up in the extended state.

In a development, it is possible for just one of the supporting rods 11 to be mounted axially in the bottom part 3 such that they are secured against tilting, and for the rest of the supporting rods 11 merely to be guided in the bottom part 3. For such a purpose, for example, the one supporting rod 11 may be mounted in two pairs of rollers that are disposed one above the other and, in such a case, in each case at least one roller has a constriction or indent to make possible a securing of the supporting rod against tilting in all directions. The rest of the supporting rods 11, in this configuration, may be guided in simple openings in the bottom part 3. It is, thus, possible to achieve the situation where skewing of two or more supporting rods 11 does not result in the entire load-bearing structure 5 skewing during the extending and pushing-in operations. The guidance is, thus, improved to a considerable extent. In this configuration, provision may be made for the front supporting tubes, which are disposed on both sides of the button-strip clamp 13, to be connected to one another by a cross member, beneath the axial mount or guide, within the bottom part 3, in order to achieve additional stabilization. Above the guide or the mount, all the supporting rods 11 are connected to one another, in particular, at their top end. It is also possible for the button-strip clamp 13 to be fastened on this cross member and, thus, to be coupled to the load-bearing structure 5 in respect of vertical displacement.

It may be possible for the load-bearing structure 5 to be arrested in the extended state and/or in the pushed-in state. To make it easier for the load-bearing framework 5 to be extended, it is also possible to provide a spring element that forces the load-bearing framework 5 upward counter to its weight. For example, it is possible to provide a roller spring that, advantageously, has a largely linear force profile. To simplify handling, the arresting mechanism may be configured to lock the load-bearing framework 5 at the bottom when first lowered and to unlock it again when forced in again. In such a case, the spring is, advantageously, configured such that, without any external action, it can move the load-bearing structure 5 slowly upward.

In a development, it is also conceivable for the spring to be configured such that the load-bearing framework 5 descends slowly downward without any external force action and the operation of extending the load-bearing framework 5 is brought about by virtue of the fan 6 being switched on, the supporting bodies 2 producing the necessary upwardly directed force during the inflating operation. Once at the top, the load-bearing framework 5 can lock itself, with the result that an operator, following use of the shirt-pressing apparatus, need only unlock the load-bearing structure to allow the latter to descend slowly downward.

The load-bearing structure 5 may be connected to a damping device with speed-dependent damping. As a result, the extending and/or pushing-in operations are damped. The damping device used may be, for example, a negative-pressure braking cylinder.

Furthermore, possible measures for supporting and/or moving the load-bearing structure 5 are manual drives, for example, a crank, motor drives, damped springs, or pneumatic springs. Provision may further be made for the locking and/or unlocking to be brought about by a turning action.

We claim:

1. An apparatus for pressing shirts, comprising:

a flexible inflatable body having a bottom section and a top section;

a bottom part having a fan communicating with said inflatable body for inflating said inflatable body, said inflatable body fastened to said bottom part at said bottom section;

a load-bearing structure disposed within said inflatable body and connected in a vertically displaceable manner to said bottom part;

a top part being disposed above said bottom part, said inflatable body fastened to said top part at said top section, said load-bearing structure connecting said top part to said bottom part; and said load-bearing structure being movably disposed to assume:

an extended position in which said load-bearing structure is extended out of said bottom part when the apparatus is in operation; and a retracted position in which said load-bearing structure is retracted into said bottom part when the apparatus is not in operation.

2. The apparatus according to claim 1, wherein said load-bearing structure lowers into said bottom part.

3. The apparatus according to claim 1, wherein said load-bearing structure lowers substantially entirely into said bottom part.

4. The apparatus according to claim 1, further comprising a connecting device for transmitting at least one of tensile forces and compressive forces, said connecting device connecting said load-bearing structure to said inflatable body between regions in which said inflatable body is fastened to said bottom part and to said top part, said connecting device being displaceably connected along said load-bearing structure.

5. The apparatus according to claim 4, wherein:

said inflatable body has an inside; and said connecting device is pulling strips fastened on said inside and delimit inflation of said inflatable body.

6. The apparatus according to claim 4, wherein said connecting device is inflatable air cushions disposed in said inflatable body and forcing said inflatable body outward at given locations.

7. The apparatus according to claim 1, further comprising a button-strip clamp for fixing one of the button strip of a shirt and a buttonhole strip of the shirt, said button-strip clamp being fastened in a vertically displaceable manner on said bottom part.

8. The apparatus according to claim 7, wherein said button-strip clamp and said load-bearing structure are coupled to one another with respect to vertical displacement.

9. The apparatus according to claim 7, wherein said button-strip clamp and said load-bearing structure are vertical displaceably coupled to one another.

10. The apparatus according to claim 7, wherein said button-strip clamp has a top connected to said top part.

11. The apparatus according to claim 7, wherein:

said button-strip clamp has a rear side;

said inflatable body with said load-bearing structure pushes upward in an inflated state of said inflatable body and butts against said rear side of said button-strip clamp in the pushed upward state;

said button-strip clamp has clamping surfaces against which one of the button strip or the buttonhole strip are to be pressed for fixing the button strip or the buttonhole strip, said clamping surfaces define a plane and have lateral borders; and said rear side of said button-strip clamp is located in a vicinity of said plane of said clamping surfaces at least at said lateral borders.

12. The apparatus according to claim 11, wherein:

said clamping surfaces have outer borders;

said rear side of said button-strip clamp has borders; and said borders of said rear side of said button-strip clamp are connected to said outer borders of said clamping surfaces and enclose an acute angle with said outer borders of said clamping surfaces.

13. The apparatus according to claim 1, wherein:

said load-bearing structure has a plurality of supporting rods connected to one another and disposed substantially parallel to one another;

only one of said supporting rods is mounted axially in said bottom part and is secured against tilting; and a remainder of said supporting rods are guided axially in said bottom part and are not secured against tilting.

* * * * *